US005564939A

United States Patent [19]

Maitani et al.

[11] Patent Number: 5,564,939

[45] Date of Patent: Oct. 15, 1996

[54] CONNECTOR HAVING A LATCH MECHANISM

[75] Inventors: Yukihiro Maitani; Takeshi Okuyama; Manabu Shimizu; Hideo Miyazawa; Kouji Watanabe, all of Kawasaki, Japan

[73] Assignee: Fujitsu Limited, Japan

[21] Appl. No.: 437,562

[22] Filed: May 9, 1995

Related U.S. Application Data

[63] Continuation of Ser. No. 118,749, Sep. 10, 1993, abandoned.

[30] Foreign Application Priority Data

Nov. 19, 1992 [JP] Japan ..... 4-310475
Apr. 28, 1993 [JP] Japan ..... 5-103290

[51] Int. Cl.[6] ..... H01R 13/627

[52] U.S. Cl. ..... 439/352; 439/357

[58] Field of Search ..... 439/350, 351, 439/352, 353, 354, 355, 356, 357, 358, 255, 258

[56] References Cited

U.S. PATENT DOCUMENTS 3,484,736 12/1969 Wyse ..... 439/255
4,941,849 7/1996 Fujuira ..... 439/357
5,315,064 5/1994 Andrews ..... 439/258

*Primary Examiner*—Hien D. Vu
*Attorney, Agent, or Firm*—Staas & Halsey

[57] ABSTRACT

A plug-in connector includes a connector main body having contacts connected to a cable, and a housing accommodating the connector main body. Latch springs are respectively attached to first and second surfaces of the housing, and respectively have first engagement portions which engage, in a locked state, second engagement portions of a jack connector to be connected with the plug-in connector. An operating member, which cooperates with the latch springs, includes latch releasing portions respectively engaging with the latch springs and disengaging the latch springs from the second engagement portions when the plug-in connector is pulled whereby the plug-in connector is released from the locked state.

2 Claims, 18 Drawing Sheets

CONNECTOR HAVING A LATCH MECHANISM

This application is a continuation of application Ser. No. 08/118,749, filed Sep. 10, 1993, now abandoned.

BACKGROUND OF THE INVENTION

1. Field of the Invention

The present invention generally relates to connectors, and more particularly to a connector having a latch mechanism for preventing the connector connected at an end of a cable from being disengaged from a connector fastened to the body of an electronic device.

Recently, there has been considerable activity in downsizing of electronic devices and improvement in the functions thereof. For these purposes, it is required to arrange a plurality of connectors arranged with a high density on, for example, a back surface of an electronic device. In terms of maintenance of electronic devices, it is necessary for an arbitrary connector to be able to be pulled out. Further, in order to improve the reliability of connections of the connectors, it is necessary to prevent the connectors from being disengaged even when the connectors are erroneously pulled.

2. Description of the Prior Art

FIG. 1 shows a conventional plug-in connector 1 provided at an end of a cable 2. The plug-in connector 1 is equipped with a pair of latch springs 3 and 4 located on the opposite sides of the plug-in connector 1. The latch springs 3 and 4 function to prevent the plug-in connector 1 from being disengaged from a jack connector 6.

Referring to FIG. 2 in addition to FIG. 1, plug-in connectors 1, 1A and lB are engaged with jack connectors 6 fastened to a backboard 5 of an electronic device and arranged side by side. Claws 3*a* and 4*b* formed at the tip ends of the latch springs 3 and 4 engage recess portions 7 and 8 of the jack connectors 6. As shown in FIG. 1, operating units 3*b* aand 4*b* for disengaging the claws 3*a* and 4*a* from the recess portions 7 and 8 are provided on the opposite sides of the plug-in connector 1.

As indicated by a two-dot chained line shown in FIG. 2, the operating units 3*b* and 4*b* are held by fingers 10 and 11 of an operator so that the claws 3*a* and 4*a* are pulled out from the recess portions 7 and 8 whereby the plug-in connector 1 is switched to a lock released state. Further, by pulling the connector 1 with the operating units 3*b* and 4*b* being held by the fingers 10 and 11 towards the operator, the connector 1 is pulled out from the jack connector 6.

However, the conventional plug-in connector 1 shown in FIGS. 1 and 2 has the following disadvantage. As shown in FIG. 2, it is necessary to provide spaces 12 and 13 into which the fingers 10 and 11 of the operator can be inserted in order to hold the operating units 3*b* and 4*b*. Normally, the size A1 of the spaces 12 and 13 is as large as approximately 10 mm. Hence, a plurality of plug-in connectors 1 (jack connectors 6) cannot be juxtaposed with a high density.

SUMMARY OF THE INVENTION

It is a general object of the present invention to provide a connector in which the above disadvantage is eliminated.

A more specific object of the present invention is to provide a connector making it possible to arrange a plurality of connectors side by side with a high density without any space being needed for accommodating fingers of an operator.

The above objects of the present invention are achieved by a plug-in connector comprising: a connector main body having contacts connected to a cable; a housing accommodating the connector main body; latch springs respectively attached to first and second surfaces of the housing, the latch springs respectively having first engagement portions which engage, in a locked state, second engagement portions of a jack connector to be connected with the plug-in connector; and an operating member cooperating with the latch springs, the operating member including latch releasing portions respectively engaging the latch springs and disengaging the latch springs from the second engagement portions when the plug-in connector is pulled, whereby the plug-in connector is released from the locked state.

The above objects of the present invention are also achieved by a plug-in connector comprising: a connector main body having contacts connected to a cable; a housing accommodating the connector main body; latch springs attached to first and second surfaces of the housing, the latch springs respectively having first engagement portions which engage, in a locked state, second engagement portions of a jack connector to be connected with the plug-in connector; and an operating member cooperating with the latch springs, the operating member including latch releasing portions respectively engaging the latch springs and disengaging the latch springs from the second engagement portions when the plug-in connector is pulled, whereby the plug-in connector is released from the locked state, the latch springs respectively having push portions causing the first engagement portions to be disengaged from the second engagement portion when the push portions are pushed whereby the plug-in connector is also released from the locked state.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 3A:
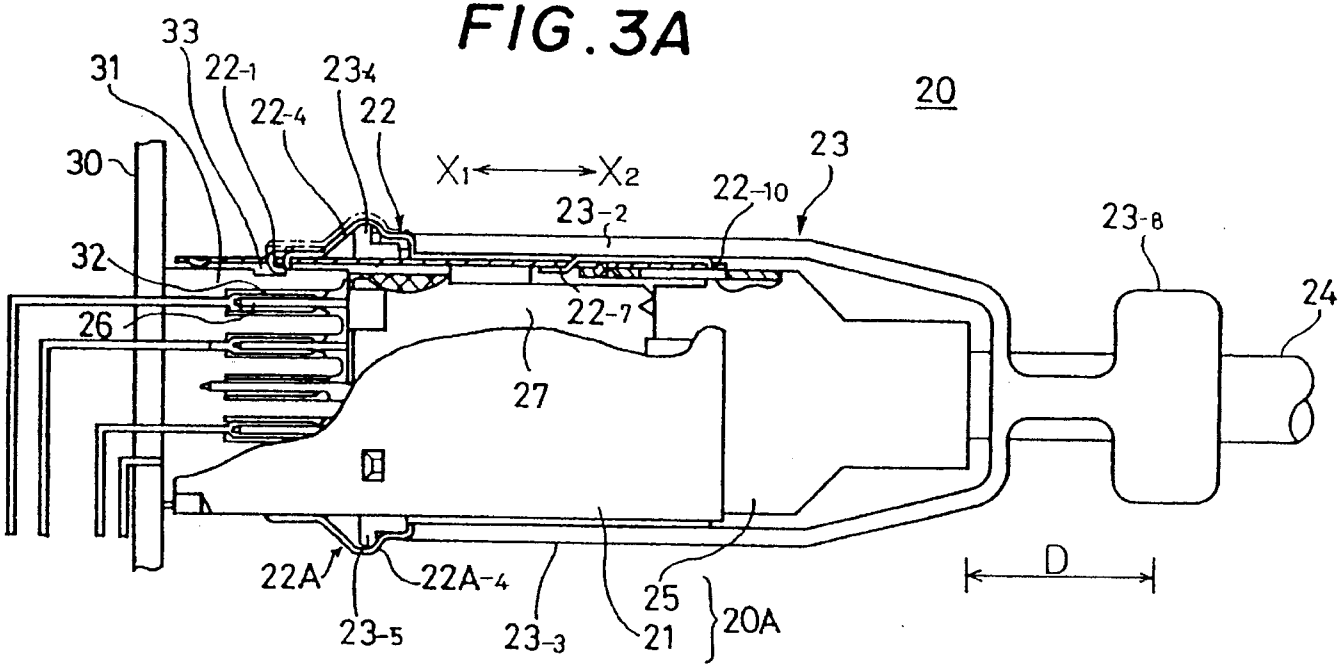
FIG. 3A is a front view of a plug-in connector according to a first embodiment of the present invention.
Figure 3B:
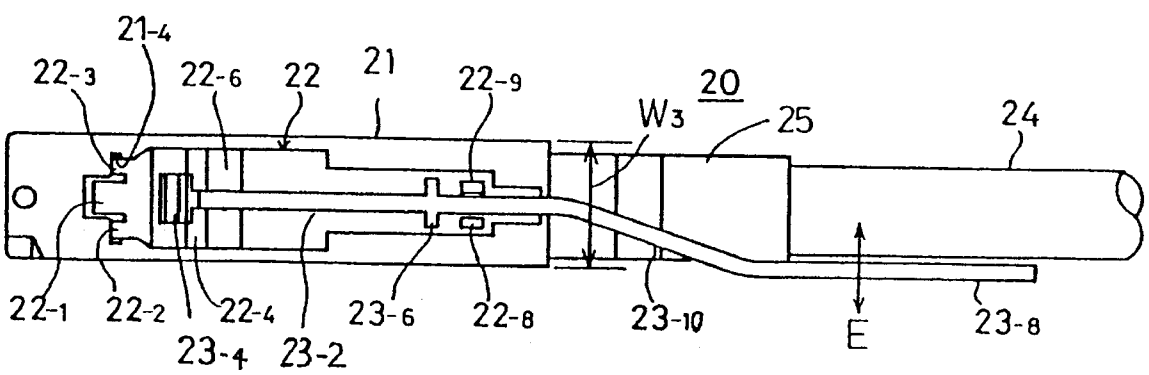
FIG. 3B is a plan view of the plug-in connector shown in FIG. 3A.
Figure 3C:
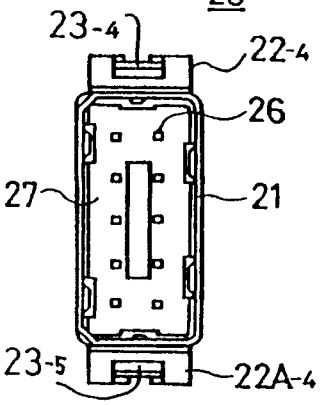
FIG. 3C is a side view of the plug-in connector shown in FIGS. 3A and 3B.

FIGS. 3A, 3B and 3C are diagrams of a plug-in connector 20 according to a first embodiment of the present invention. The plug-in connector 20 includes a shield housing 21 made of a metallic material, latch springs 22 and 22A respectively provided on upper and lower surfaces of the housing 21, and an operating member 23. As shown in FIGS. 3A and 3B, at a rear end of the housing 21, a cable clamp 25 is provided that clamps an end of a cable 24. The plug-in connector 20 is provided at the-end of the cable 24, and the cable 24 extends from the rear end of the plug-in connector 20. The housing 21 and the cable clamp 25 form a connector main body 20A. A block 27 in which male contacts 26 are embedded is provided in the housing 21 so that the block 27 engages cut and bent portions 21-1 (FIG. 5) of the housing 21.

Figure 6:
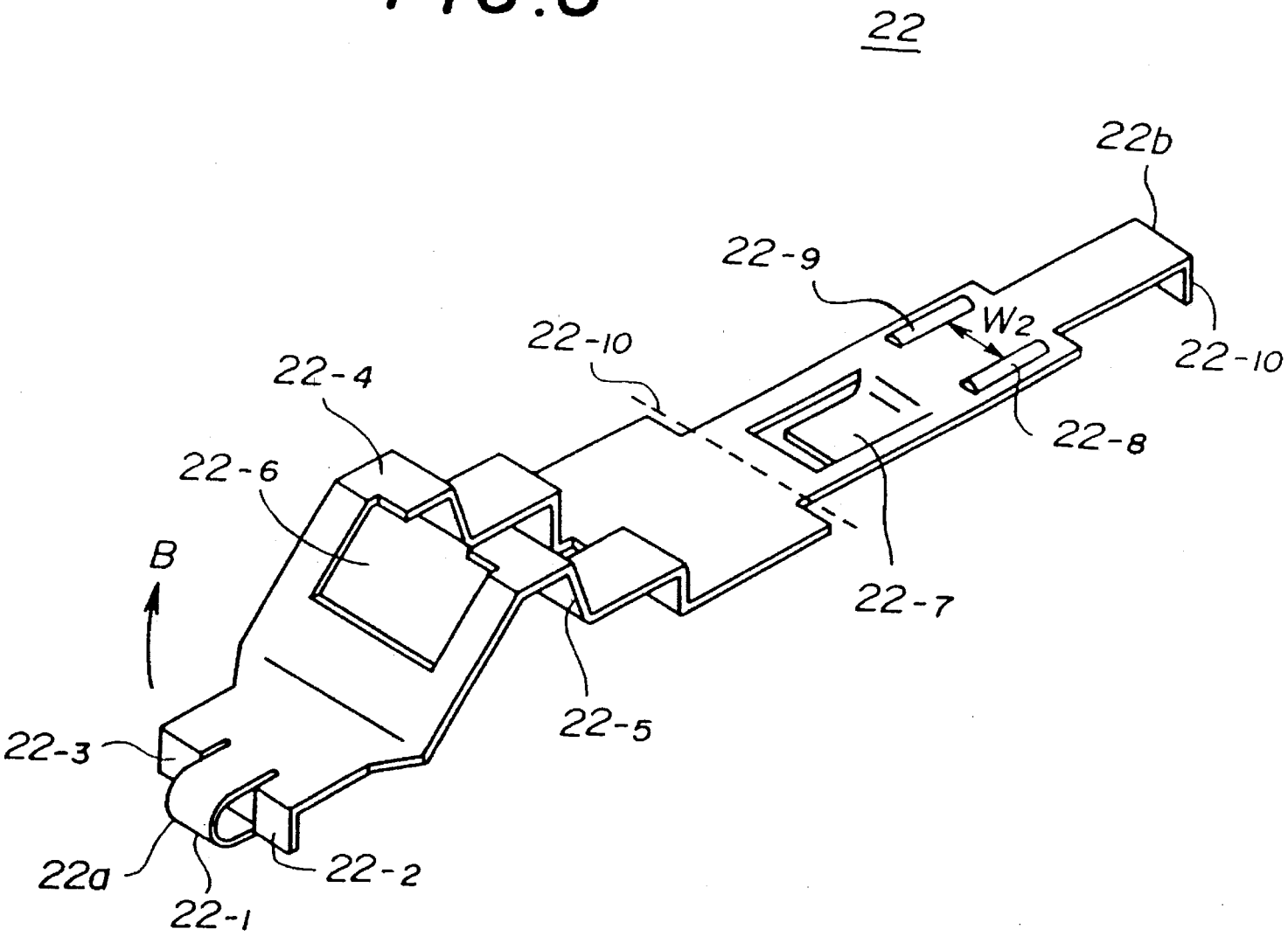
FIG. 6 is a perspective view of a latch spring of the plug-in connector according to the first embodiment of the present invention.

As shown in FIG. 6, the latch spring 22 includes a U-shaped claw 22-1 formed at a tip end **22*a* of the spring 22, and tongue-shaped portions 22-2 and 22-3 formed on the opposite sides of the claw 22-1. An angle portion 22-4 is formed in the vicinity of the tip end 22*a* of the spring 22. A slope portion 22-5 forms a part of the angle portion 22-4. A cut 22-6 to be engaged with the operating member 23 is formed in the angle portion 22-4. A cut and bent piece 22-7, and a pair of stoppers 22-8 and 22-9 are formed from the angle portion 22-4 towards a root portion of the spring 22 in that order. The stoppers 22-8 and 22-9 are formed by cutting the spring and deforming cut portions so that semi-cylindrical portions are formed. The stoppers 22-8 and 22-9 are spaced apart from each other by a width W2, which corresponds to a width W1 of an arm portion 23-2 (FIG. 7) of the operating member 23. As shown in FIG. 6, an L-shaped tongue portion 22-10 is formed at the other end of the spring 22**.

Figure 5:
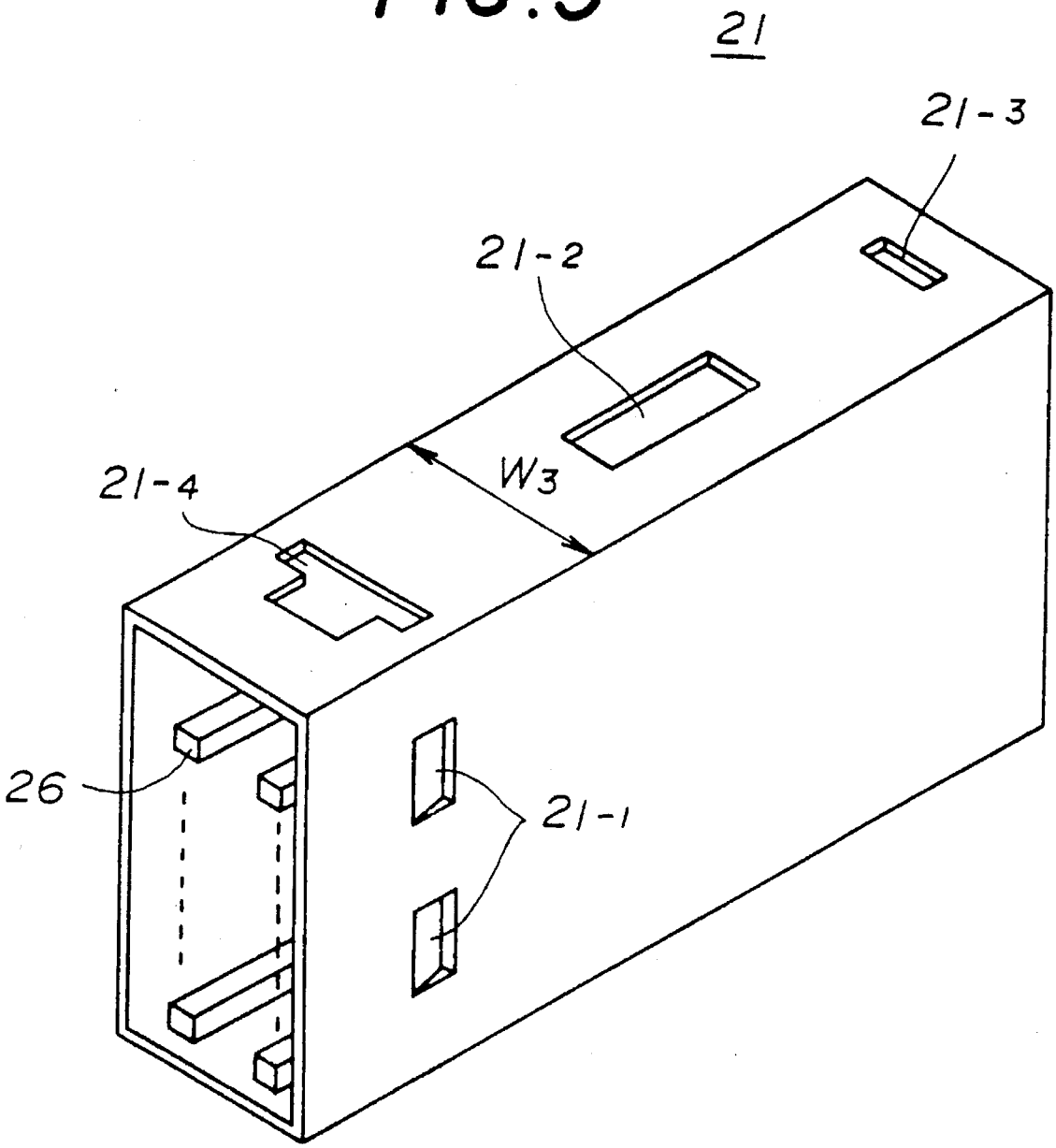
FIG. 5 is a perspective view of a metallic shield housing of the plug-in connector according to the first embodiment of the present invention.

As shown in FIGS. 3A, 3B and 5, the latch spring 22 is attached to the upper surface of the housing 21 in the following state. The cut and deformed piece 22-7 (FIG. 6) passes through an opening 21-2 (FIG. 5) of the housing 21, and enters into the housing 21, whereby the housing 21 is clamped. The tongue portion 22-10 (FIG. 6) engages a slit 21-3 (FIG. 5) so that the tongue portion 22-10 is inserted into the slit 21-3. The claw 22-1 (FIG. 6), the tongue portions 22-2 and 22-3 (FIG. 6) engages an opening 21-4 (FIG. 5) so that the tongue portion 22-10 is inserted into slit 21-3.

Figure 9A:
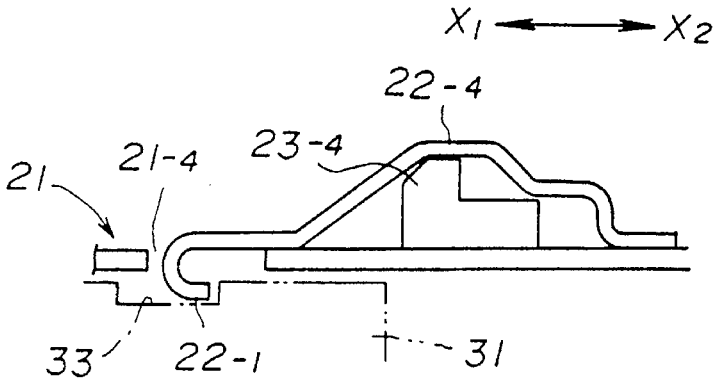
FIGS. 9A, 9B and 9C are diagrams illustrating a lock releasing operation of the first embodiment of the present invention.

The claw 22-1 enters into the housing, as shown in FIGS. 3A, 3B and FIG. 9A. The tongue portions 22-2 and 22-3 (FIG. 6) come into contact with edges of the opening 21-4 (FIG. 5) of the housing 21, and prevent the claw 22-1 from laterally deviating. A portion of the latch spring 22 between a position indicated by a line 22-10 (FIG. 6) and the end **22*a*** is elastically warped in a direction indicated by an arrow B (FIG. 6).

The latch spring 22A is attached to the lower surface of the housing 21 in the same manner as the latch spring 22.

Figure 7:
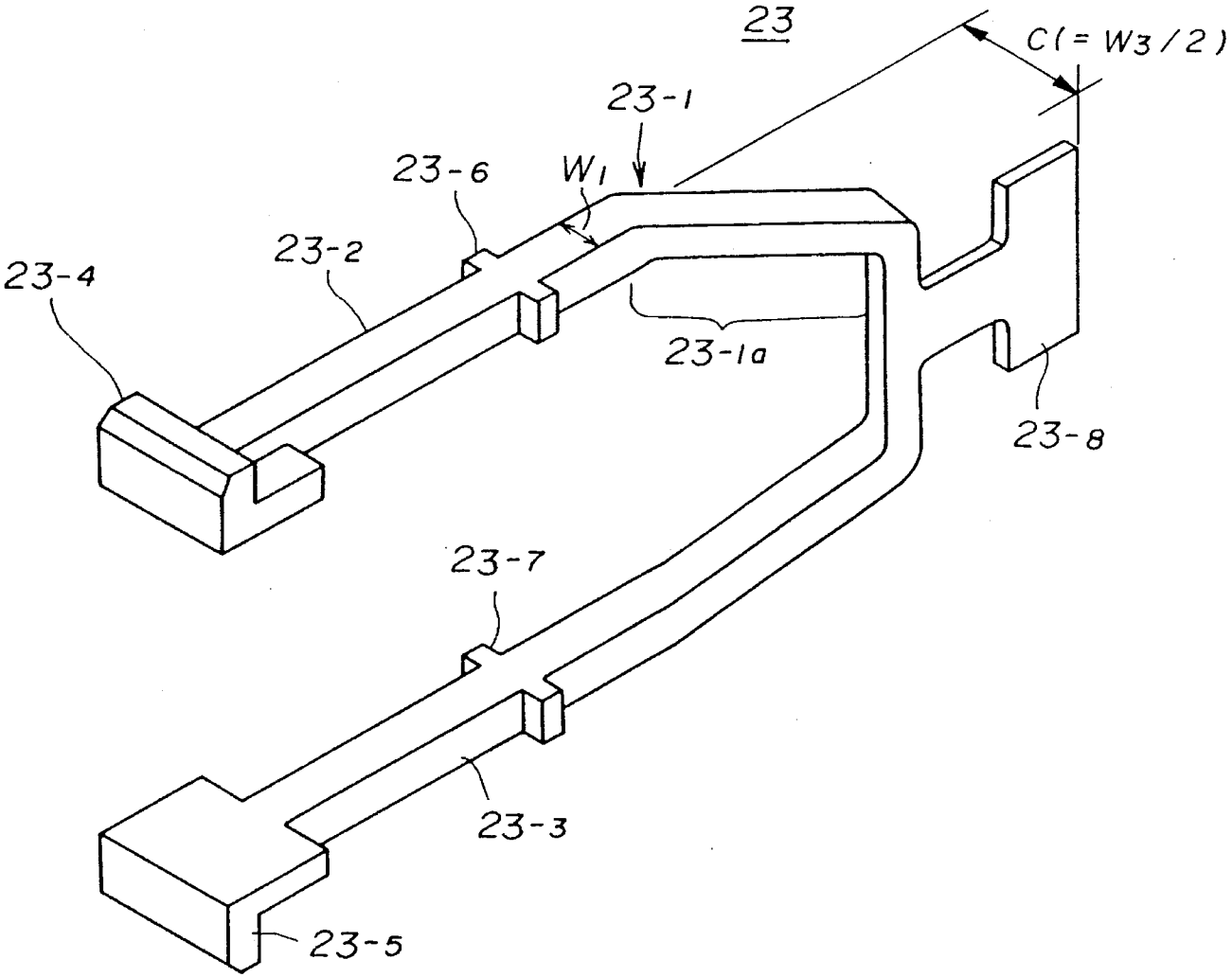
FIG. 7 is a perspective view of an operating member of the plug-in connector according to the first embodiment of the present invention.
Figure 8:
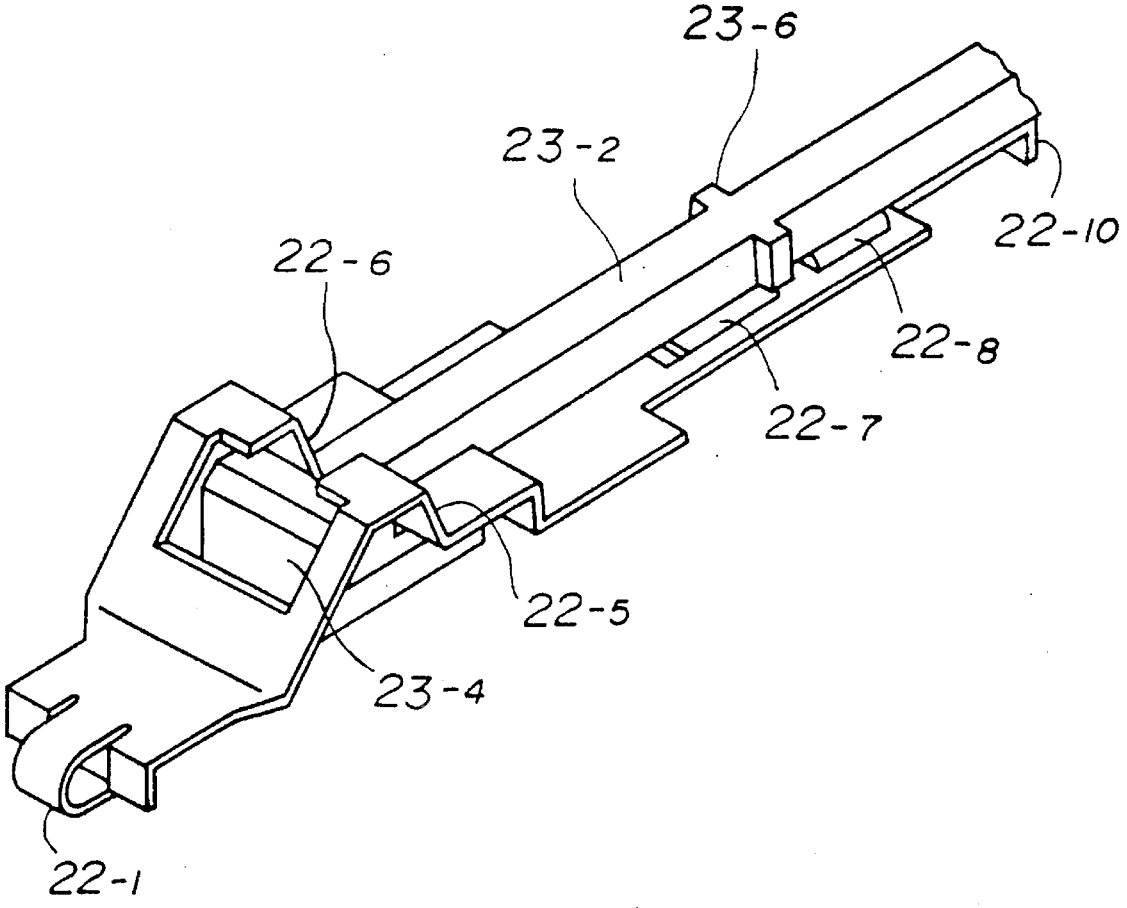
FIG. 8 is a perspective view illustrating a relationship between a part of the operating member and the latch spring.

As shown in FIG. 7, the operating member 23 includes an approximately U-shaped arm 23-1 having arms 23-2 and 23-3. A latch releasing cam 23-4 is formed at an end of the arm 23-2, and a latch releasing cam 23-5 is formed at an end of the arm 23-3. Each of the latch releasing cams 23-4 and 23-5 has an approximate L-shape and dimensions corresponding to those of the angle portion 22 of the latch spring 22-4 (FIG. 6). A projection 23-6 projecting from either side of the arm 23-2 is formed at an intermediate position of the arm 23-2. A projection 23-7 projecting from either side of the arm 23-3 is formed at an intermediate position of the arm 23-3. A T-shaped pull tab 23-8 is formed at a root position at which the arms 23-2 and 23-3 are joined together.

As shown in FIG. 3B, a bent portion **23-1*a* of the U-shaped arm 23-1 is laterally bent, and the pull tab 23-8 deviates from a plane extending from the U-shaped arm 23-1 by a distance C (FIG. 7). The distance C-corresponds to half of the width W3 (FIG. 3B) of the housing 21**.

The latch releasing cam 23-4 (FIG. 7) of the operating member 23 is located below the angle portion 22-4 of the latch spring 22, as shown in FIG. 3A. The arm 23-2 passes through the cut 22-6 (FIG. 6) and extends on the latch spring 22 and between the stoppers 22-8 and 22-9 as shown in FIG. 3B. The latch releasing cam 23-5 is located inside an angle portion 22A-4 (FIG. 3A) of the latch spring 22A. The cam 23-3 extends along the spring 22A. In the above manner, the arms 23-2 and 23-3 are attached to the connector main body 20A so as to sandwich the main body therebetween.

The pull tab 23-8 (FIG. 7) of the operating member 23 is located a distance D away from the connector main body 20A in a direction away the arms 23. The bent portion **23-1*a* (FIGS. 3B and 7) of the operating member 23 makes it possible to arrange the cable tab 23-7 close to the cable 24, as shown in FIG. 3B. Further, as shown in FIG. 3B, the width of the plug-in connector 20 including the pull tab 23-8 is less than the width W3 (FIG. 5) of the housing 21. As indicated by a reference E shown in FIG. 3B, a deviation of the operating member 23 in the direction of the width of the plug-in connector 20 is limited because a lateral deviation of the arm 23-2 (FIG. 7) is prevented by means of the stoppers 22-8 and 22-9** (FIGS. 3B and 6).

A description will now be given of the operation of the above-mentioned plug-in connector 20.

First, the operation for connecting the plug-in connector 20 to the jack connector 31 will be described below. The operator holds the connector main body 20A or the cable 24, and positions the plug-in connector 20 to the jack connector 31 fixed to the backboard 30. Hence, the male contacts 26 and female contacts 32 (FIG. 3A) are connected together, and the claw 22-1 (FIG. 6) engages the recess portion 33 (FIG. 3A) of the jack connector 31. The plug-in connector 20 is connected to the jack connector 31 in the locked state by means of the lock or latch mechanism.

Figure 9B:
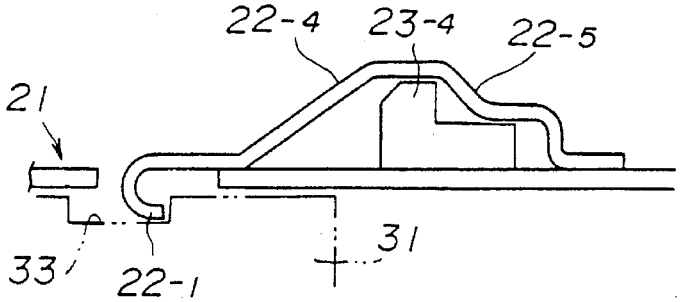
Figure 9C:
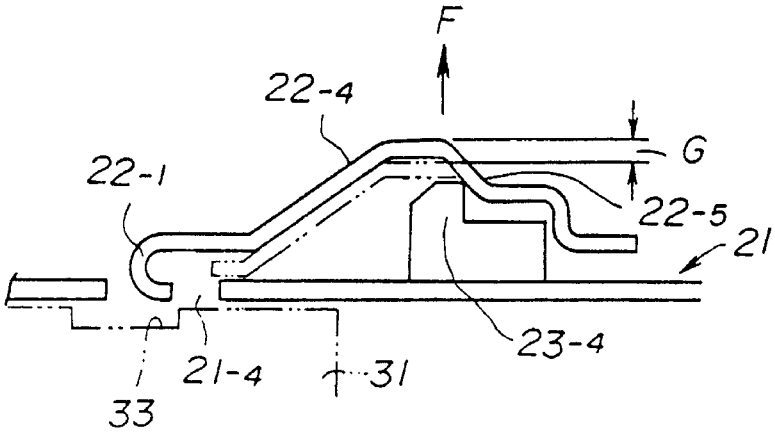

The plug-in connector 20 can be pulled out as follows. The operator uses his or her the fingers 10 and 11 to close and hold the pull tab 23-8. Then, the operator pulls the pull tab 28-8 in a direction X2 shown in FIG. 3A. At the first stage of the pull-out operation of the plug-in connector 20, only the operating member 23 is moved in the direction X2 independently of the connector main body 20A. The such as a cam 23-4 is moved, inside the angle portion 22-4, from the state shown in FIG. 9A to the state shown in FIG. 9C via the state shown in FIG. 9B. At this time, the cam 23-4 comes into contact with the third engagement portion such as a slope portion 22-5, and exerts an upwards force F on the angle portion 22-4. Hence, the latch spring 22 is elastically deformed, and the angle portion 22-4 is pushed up by a distance G shown in FIG. 9C. The distance G is approximately 2 mm. Thus, the first engagement portion such as a claw 22-1 is slipped out of the second engagement portion such as a recess portion 33, and the latch state is released. In this state, the projection 23-6 (FIGS. 3B and 7) comes into contact with the stoppers 22-8 and 22-9 (FIGS. 3B and 6).

At the second stage of the pull-out operation of the plug-in connector 20, the projection 23-6 comes into contact with the stoppers 22-8 and 22-9, so that a force pulling the pull tab 23-7 is transferred to the connector main body 20A via the latch spring 22. At this time, the plug-in connector 20 has been released from the locked state, and hence the plug-in connector 20 is pulled out from the jack connector 31. When the pull tab 23-8 is released, the cam 23-4 is pushed due to the elastic force of the latch spring 22. Hence, the operating member 23 is moved in a direction X1 shown in FIG. 9A and is automatically returned to the original position shown therein. It will be noted that the plug-in connector 20 can be released from the locked state and pulled out of the jack connector by simply pulling the operating member 23.

A description will now be given of an arrangement of the plug-in connector 20 and other plug-in connectors.

Figure 1:
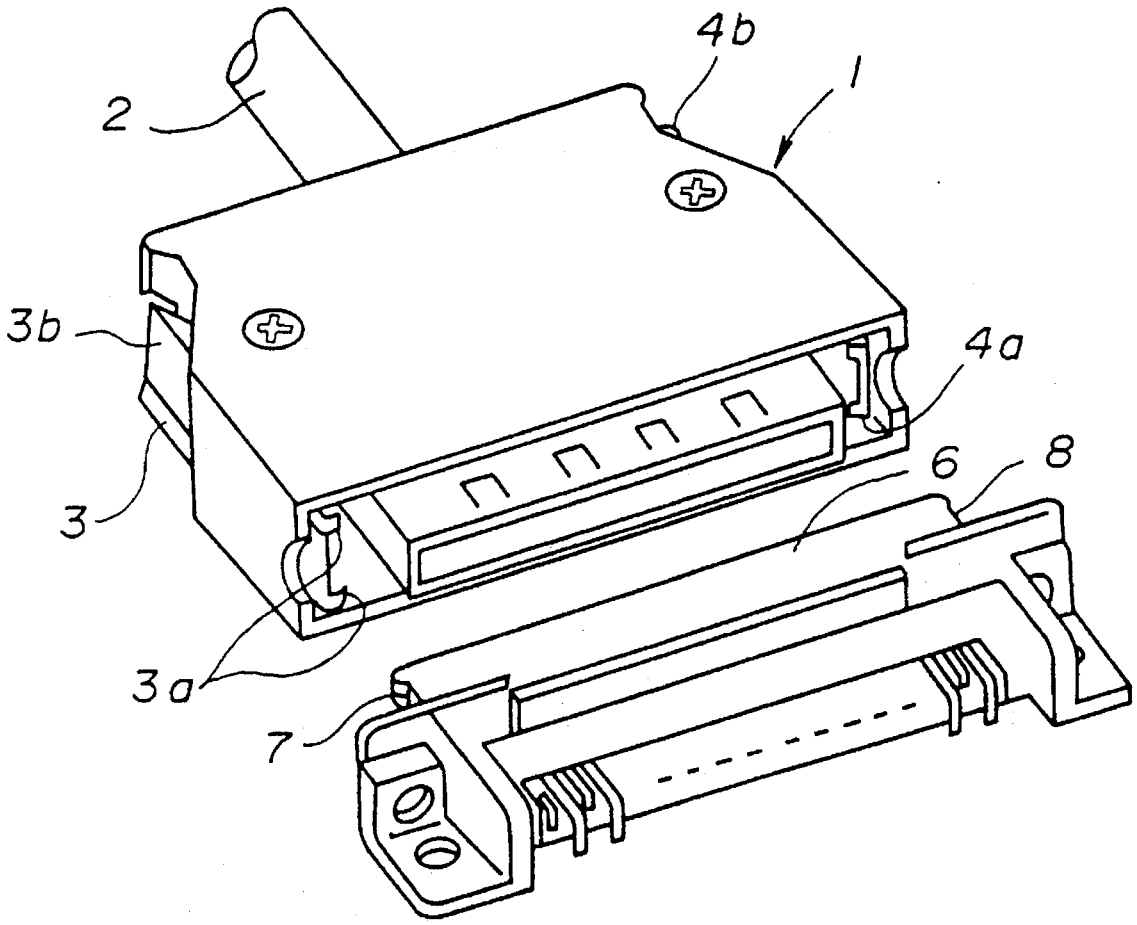
FIG. 1 PRIOR ART
FIG. 1 is a perspective view of a conventional. plug-in connector.
Figure 2:
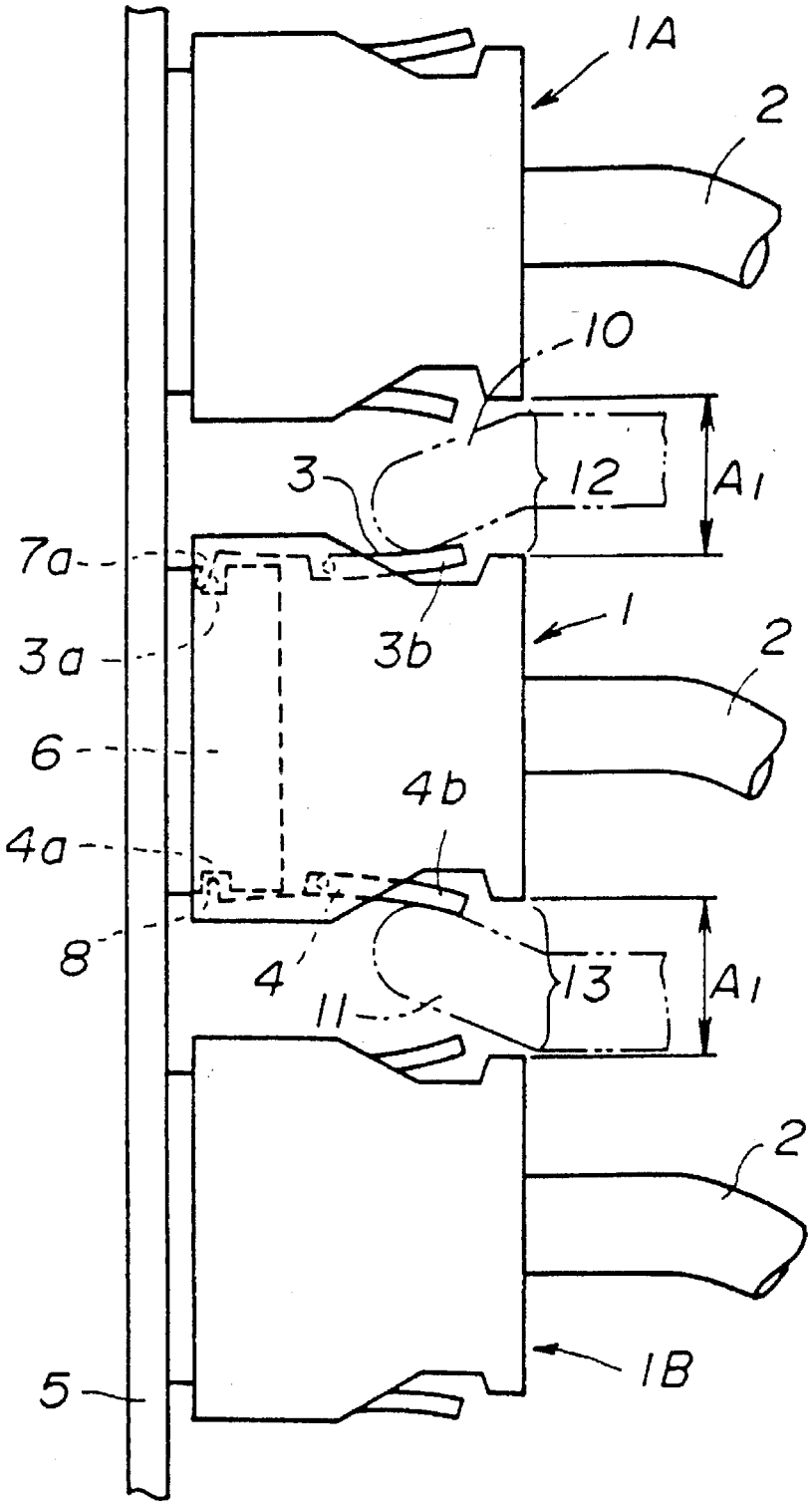
FIG. 2 PRIOR ART
FIG. 2 is a plan view of an arrangement of conventional plug-in connectors.
Figure 4:
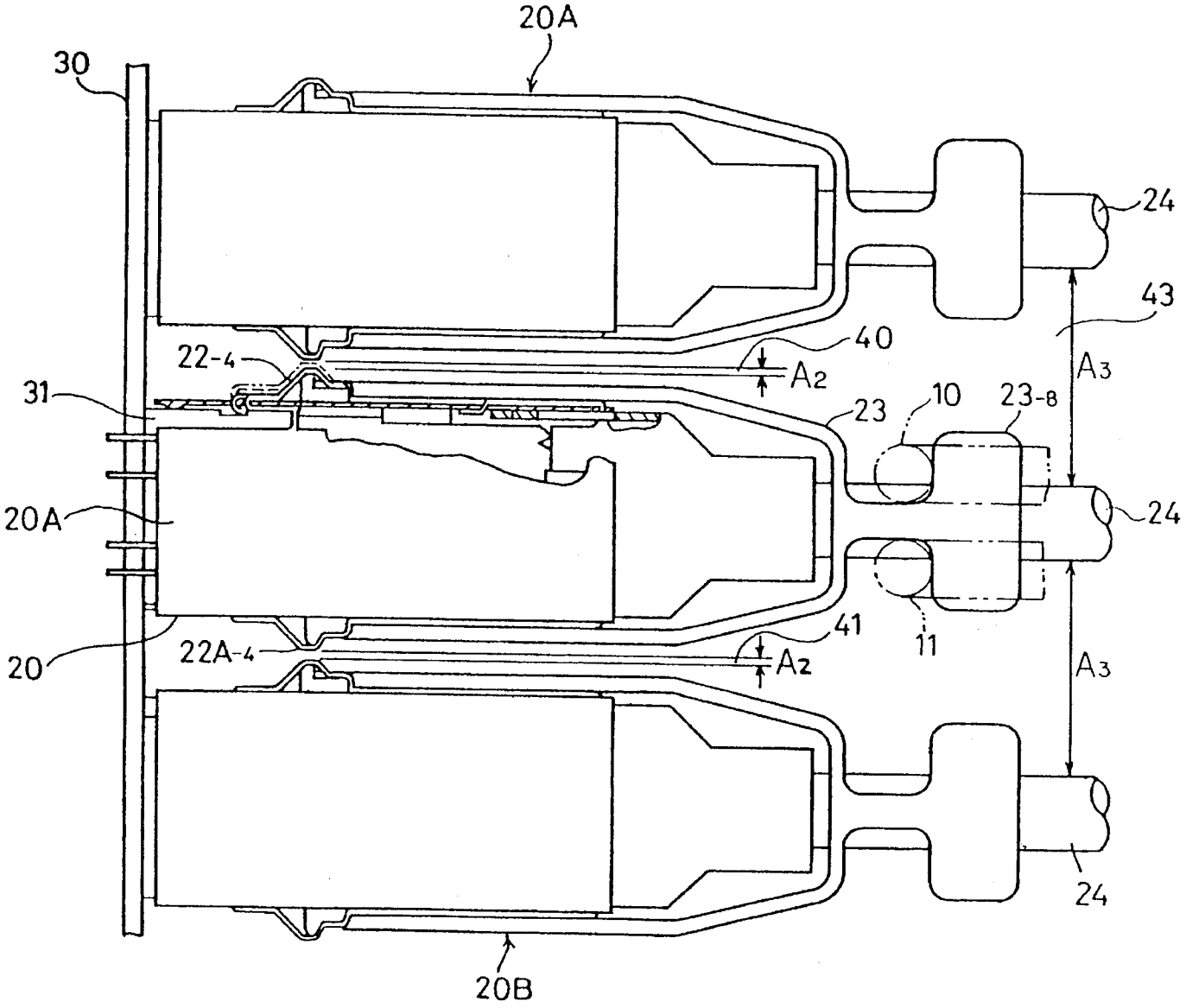
FIG. 4 is a plan view of an arrangement of plug-in connectors according to the first embodiment of the present invention.

As shown in FIG. 4, the plug-in connector 20 and a plug-in connector 20A having the same structure as the connector 20 are arranged side by side forming a space 40 between the connectors. Similarly, the plug-in connector 20 and a plug-in connector 20B having the same structure as the connector 20 are arranged side by side via a space 41. As has been described previously, it is not necessary to move the fingers to the sides of the connector main body 20A. Further, the angle portion 22-4 is allowed to laterally move only 2 mm. Hence, it is enough to provide a space of 2 mm between the plug-in connectors 20 and 20A and between the plug-in connectors 20 and 20B. Such a space corresponds to the allowable movement of the angle portions 22-4 of the plug-in connectors 20, 20A and 20B. For the above reason, the distance A2 corresponding to each of the spaces 40 and 41 is set equal to approximately 2 mm. The above distance A2 is approximately one-fifth of that for the conventional plug-in connector shown in FIGS. 1 and 2. Hence, a plurality of plug-in connectors 20 (jack connectors 31) can be arranged side by side with a very high density.

The pull tabs 23-8 of the plug-in connectors 20, 20A and 20B are located along the respective cables 24. A distance A3 (a space 43) between adjacent cables 24 is as long (wide) as approximately 20 mm. Hence, the operator can move the fingers to the pull tab 23-8 of a desired one of the connectors 20, 20A and 20B without any difficulty.

Figure 10:
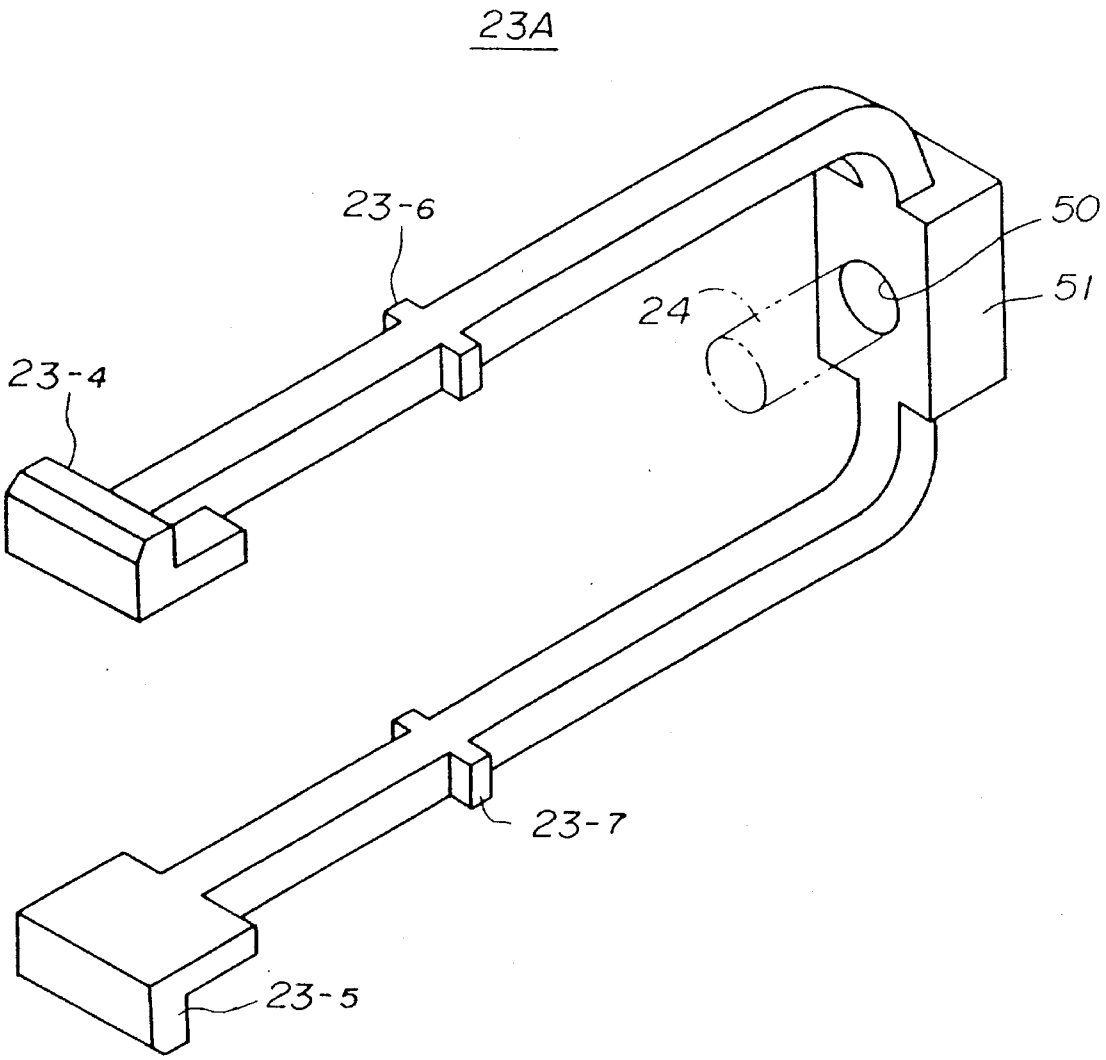
FIG. 10 is a perspective view of a variation of the operating member shown in FIG. 7.

FIG. 10 shows a variation 23A of the operating member 23. Instead of the pull tab 23-8 of the operating member 23, the operating member 23A has a grip portion 51 having a hole 50 into which the cable 24 is inserted. A lateral deviation due to the cable 24 can thus be prevented.

Figures 11A, 11B, 11C:
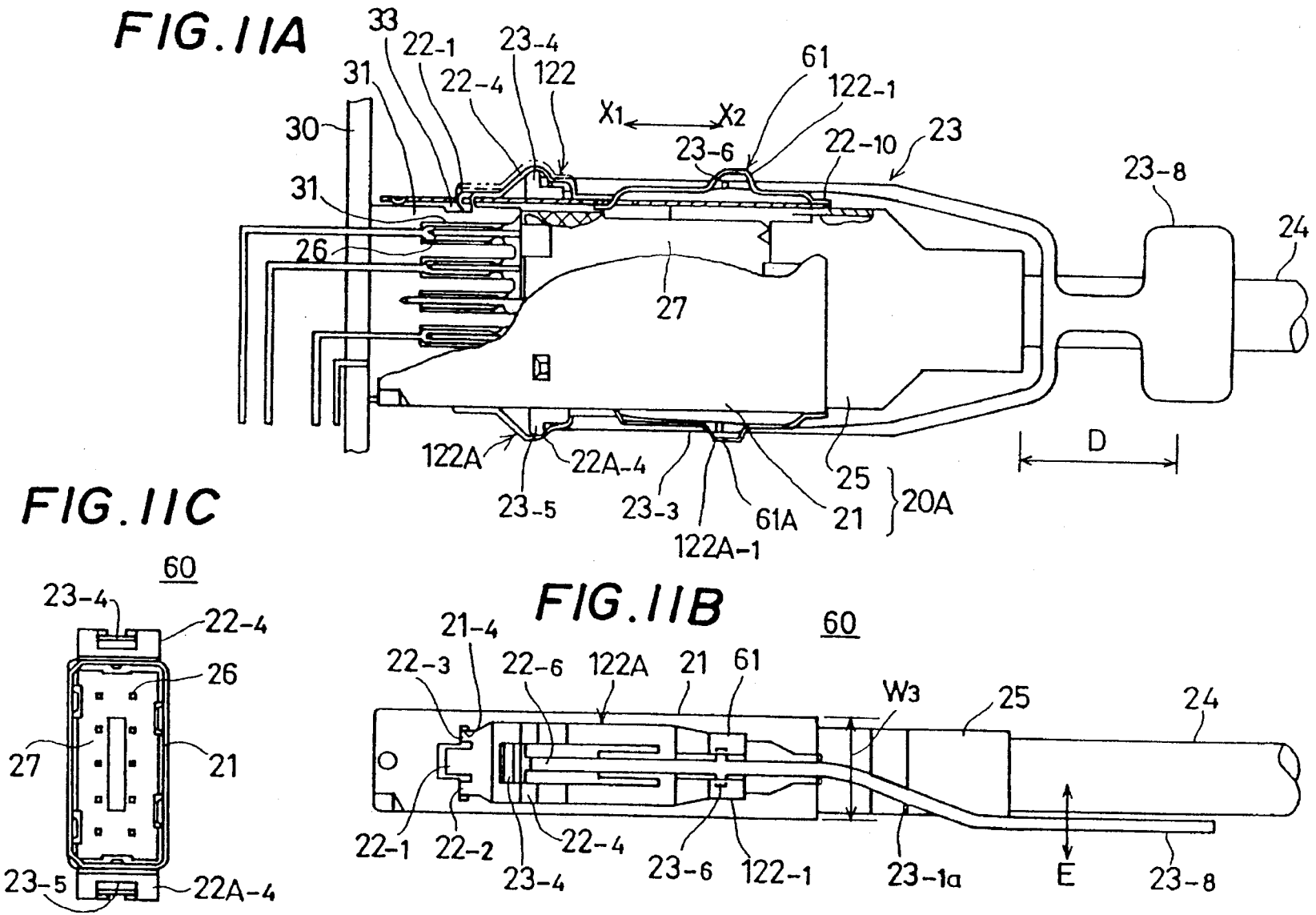
FIG. 11A is a front view of a plug-in connector according to a second embodiment of the present invention.
FIG. 11B is a plan view of the plug-in connector shown in FIG. 11A.
FIG. 11C is a side view of the plug-in connector shown in FIGS. 11A and 11B.

FIGS. 11A, 11B and 11C are respectively front, plan and side views of a plug-in connector 60 according to a second embodiment of the present invention. In FIGS. 11A, 11B and 11C, parts that substantially correspond to those shown in the previously described figures are given the same reference numbers. The plug-in connector 60 is configured by providing push portions 61 and 61A with the upper and lower sides of the plug-in connector 60 shown in FIG. 3A.

Figure 12:
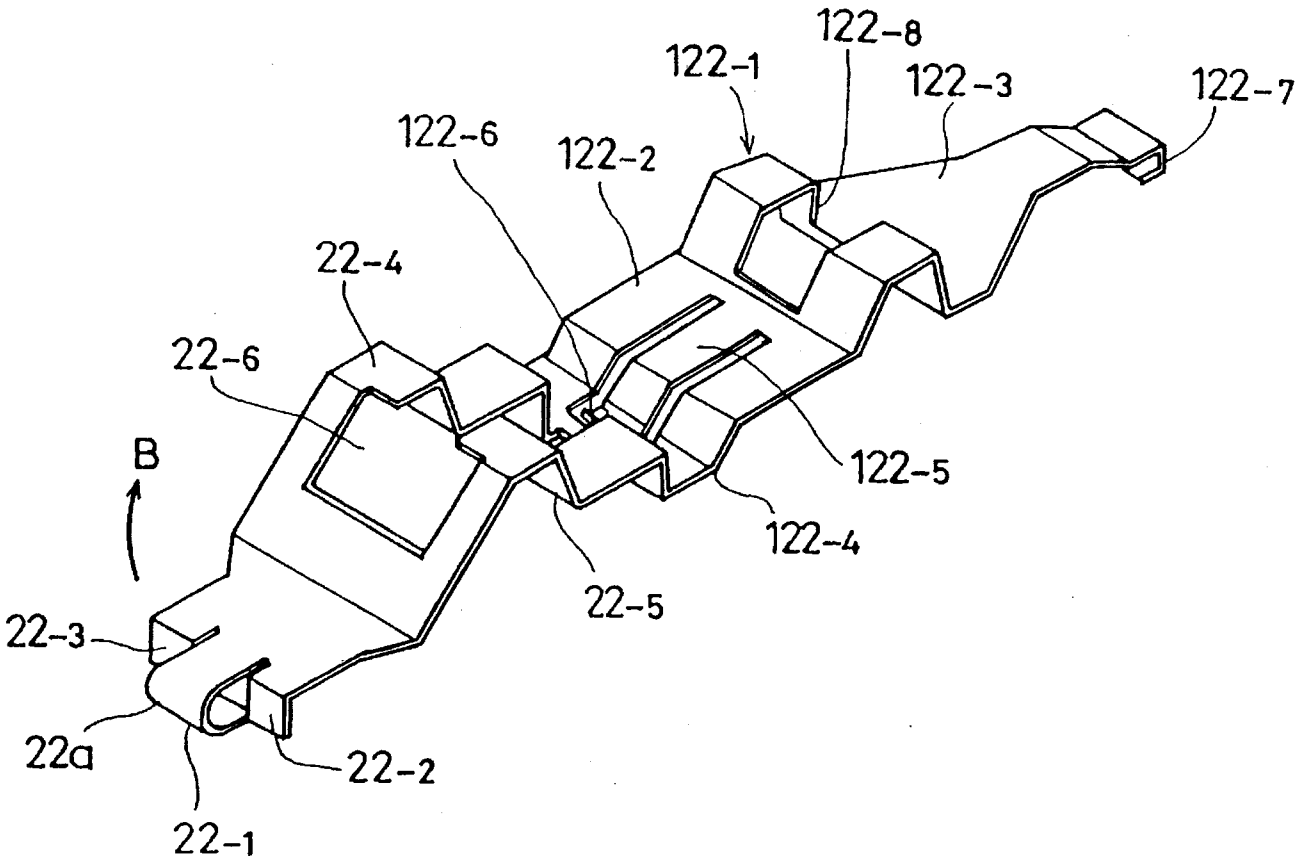
FIG. 12 is a perspective view of a latch spring of the plug-in connector according to the second embodiment of the present invention.
Figure 13:
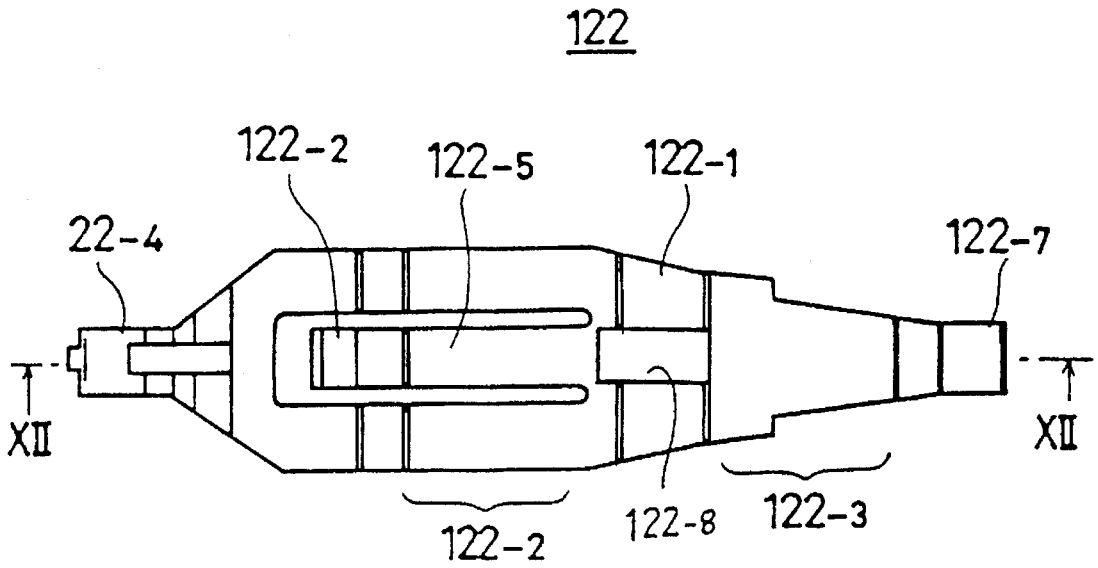
FIG. 13 is a plan view of the latch spring shown in FIG. 12.
Figure 14:
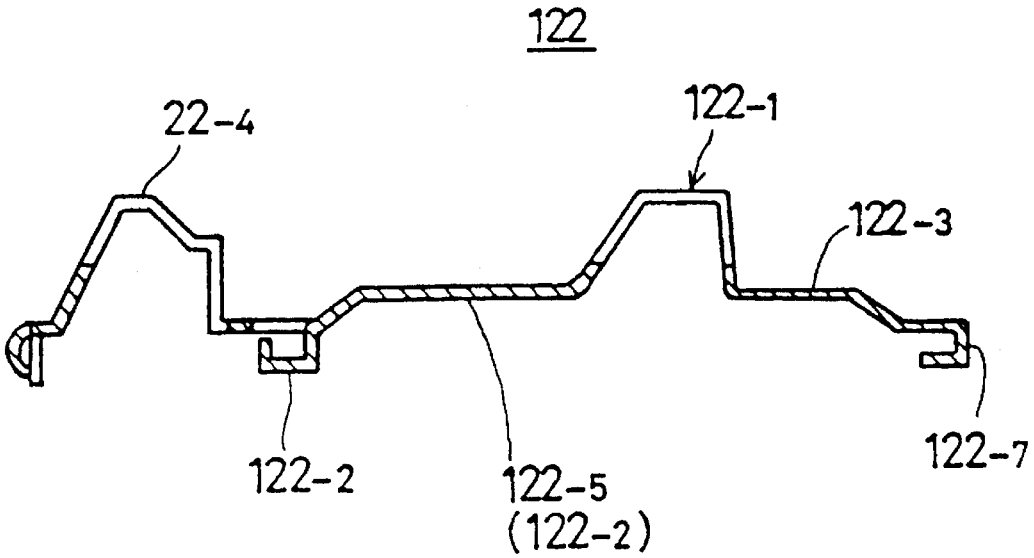
FIG. 14 is a cross-sectional view taken along a line XII—XII shown in FIG. 13.

The plug-in connector 60 has latch springs 122 and 122A, as shown in FIG. 11A. The latch spring 122 has a structure shown in FIGS. 12, 13 and 14. The latch spring 122 has the angle portion 22-4 and the claw 22-1 of the plug-in connector 60 shown in FIG. 6. Further, a shape of the angle portion 22-4 and the claw 22-1 of the plug-in connector 60A is the same as that of the plug-in connector 60. The latch spring 122 has an angle portion 122-1 at approximately the central portion thereof, the angle portion 122-1 functioning as the push portion 61. Further, the latch spring 122 comprises a step portion 122-2 extending from the angle portion 122-1 to the tip end, and a step portion 122-2 extending from the angle portion 122-1 to the root portion. The step portions 122-2 and 122-3 function as a return spring for returning the push portion 61 depressed in a manner as will described later.

The latch spring 122 has a fulcrum portion 122-4 formed at an end of the step portion 122-2. The step portion 122-2 has an arm portion 122-5 extending along the center of the step portion 122-2. A hook portion 122-6 is formed at an end of the arm portion 122-5. A hook portion 122-7 is formed at the end of the step portion 122-3, in other words, at the root portion of the latch spring 122. A cut 122-8 is formed in the angle portion 122-1.

Figure 15:
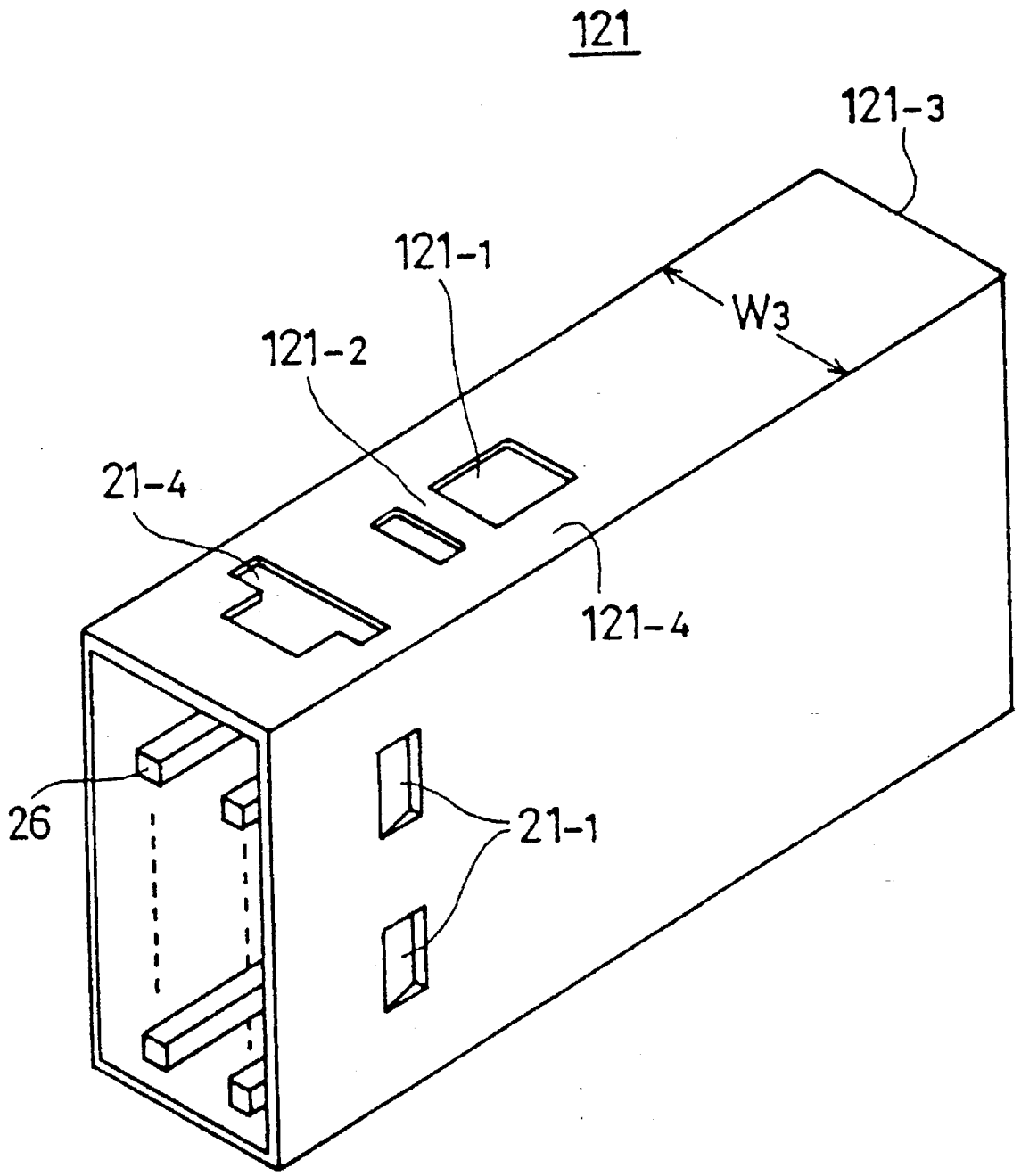
FIG. 15 is a perspective view of a metallic shield housing of the plug-in connector according to the second embodiment of the present invention.
Figure 16A:
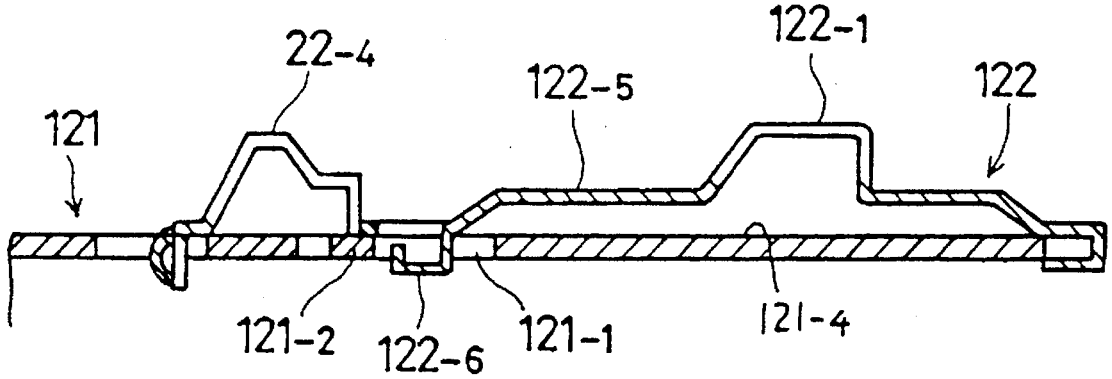
FIGS. 16A, 16B and 16C are diagrams illustrating an attachment of the latch spring to the metallic shield housing.
Figure 16B:
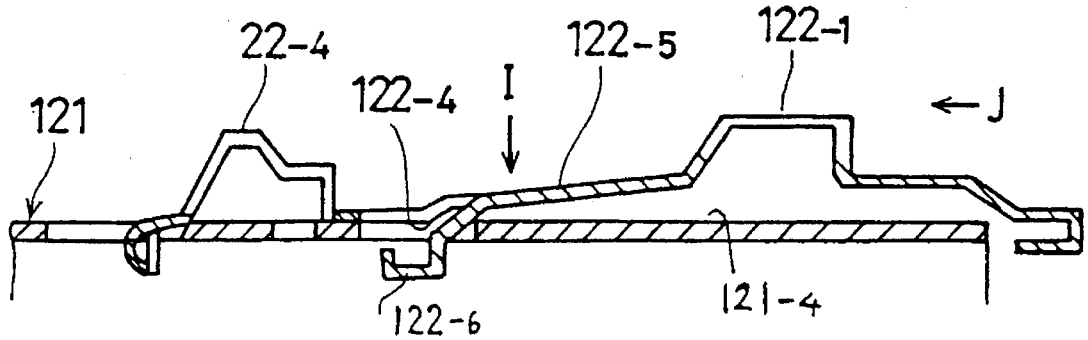

FIG. 15 shows a shield housing 121 made of a metallic material used in the second embodiment of the present invention. The latch spring 122 is attached to the metallic shield housing 121 as follows. As shown in FIG. 16A, the claw 22-1 (FIG. 12) and the tongue portions 22-2 and 22-3 are positioned at the opening 21-4, and the hook portion 122-6 is positioned at the opening 122-1. Next, as shown in FIG. 16B, the arm portion 122-5 is pushed in a direction indicated by an arrow I, so that the overall latch spring 122 is pushed in a direction indicated by an arrow J.

Figure 16C:
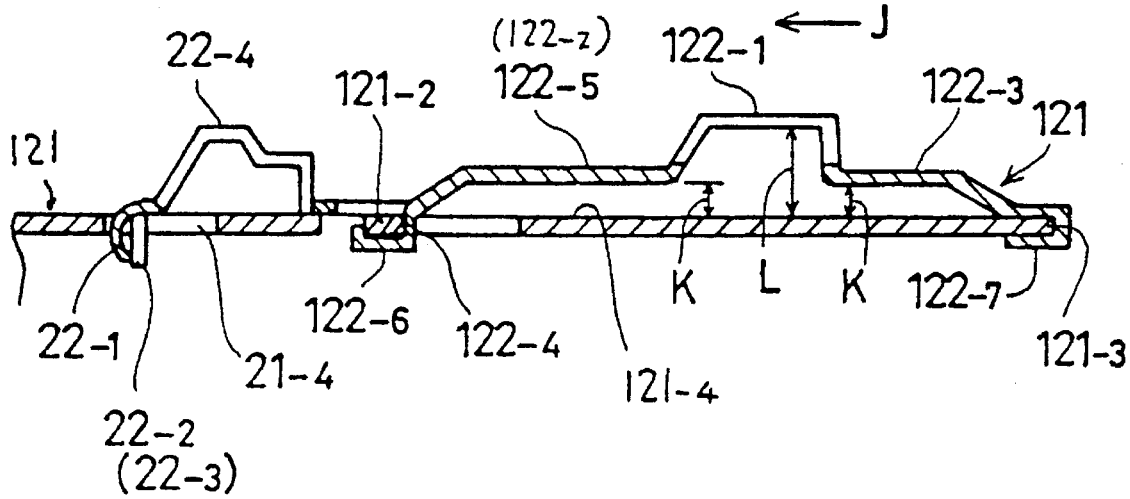

The latch spring 122 is attached to the upper surface 121-4 of the housing 121 as shown in FIG. 16C. More particularly, the claw 22-1 and the tongue portions 22-2 and 22-3 are engaged with the opening 21-4 (FIG. 15) of the housing 121. The hook portion 122-6 is engaged with a bridge portion 121-2 (FIG. 15), and the hook portion 122-7 is engaged with the end portion of the housing 121. The fulcrum portion 122-4 comes into contact with the upper surface 121-4 of the housing 121, and the step portions 122-2 and 122-3 are held above the upper surface 121-4 a distance K (FIG. 16C) therefrom. The height L (FIG. 16C) of the angle portion 122-1 with respect to the upper surface 121-4 of the housing 121 is the same as that of the angle portion 22-4.

As shown in FIGS. 11A and 11C, the latch spring 122A is attached to the lower surface of the housing 121 in the same manner as the latch spring 122.

Figure 17:
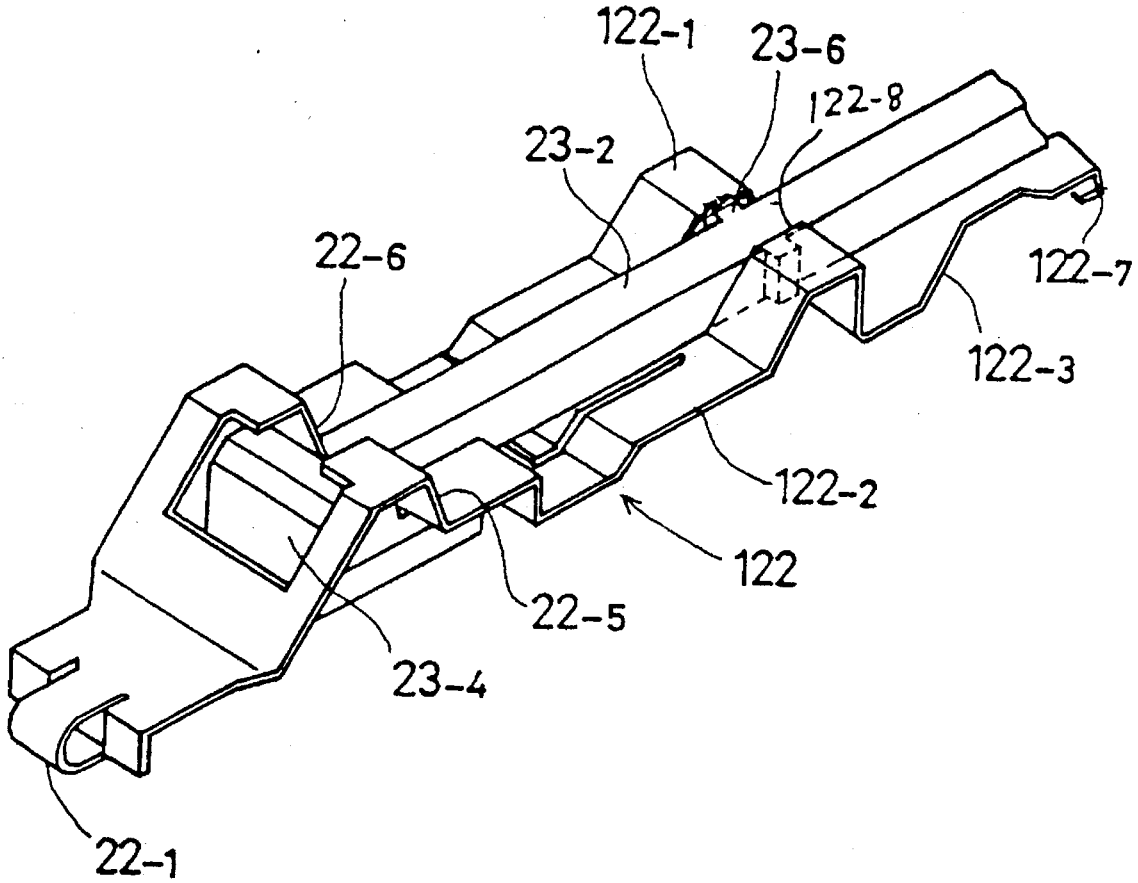
FIG. 17 is a perspective view illustrating a relationship between a part of the operating member and the latch spring according to the second embodiment of the present invention.

As shown in FIG. 17, the latch releasing cam 23-4 is positioned inside the angle portion 22-4. The arm portion 23-2 passes through the cut 122-8, and the projection 23-6 is located inside the angle portion 122-1.

The operation of the plug-in connector 60 having the above-mentioned structure will now be described. The connecting operation of the plug-in connector 60 can be carried out in the same manner as the plug-in connector 20 shown in FIGS. 3A, 3B and 3C.

The pull-out operation of the plug-in connector 60 can be carried out by either pulling the pull tab 23-8 in the direction indicated by the arrow X2 (FIG. 11A) or pushing the push portions 61 and 61A.

Figure 18A:
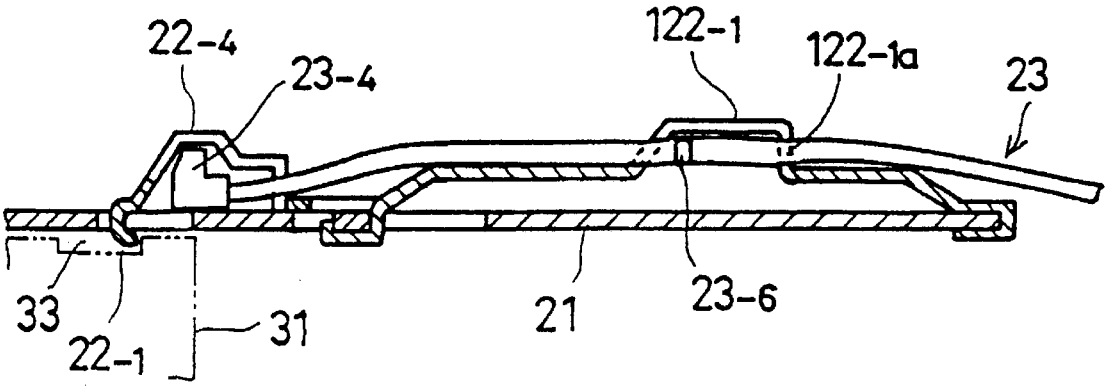
FIGS. 18A and 18B are diagrams illustrating a pull-out operation of the plug-in connector using a pull tab according to the second embodiment of the present invention.
Figure 18B:
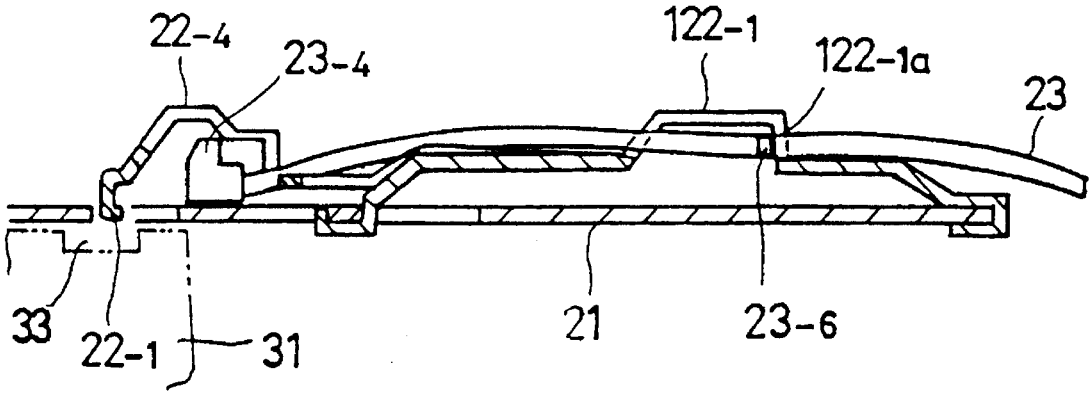

The pull-out operation by pulling the pull tab 23-8 will be described in detail below. It will now be assumed that the plug-in connector is arranged together with other identical plug-in connectors in the same manner as in the case shown in FIG. 4. Referring to FIG. 18A, when the pull tab 23-8 is pulled, the angle portion 22-4 is pushed up due to the function of the cam 23-4, and the claw 22-1 is slipped out of the recess portion 33. In this manner, the plug-in connector 60 is released from the latched state. Further, the projection 23-6 comes into contact with a vertical portion 122-1a of the angle portion 122-1, and a pulling force is transferred to the connector 60 (FIG. 18B). Hence, the plug-in connector 60 can be pulled out of the jack connector 31.

The pull-out operation utilizing the push portions 61 and 61A will be described in detail below. This pull-out operation is effective in a situation in which there is a connector on either side of the plug-in connector 60 to be pulled out or a situation in which plug-in connectors are alternately arranged.

Figure 19A:
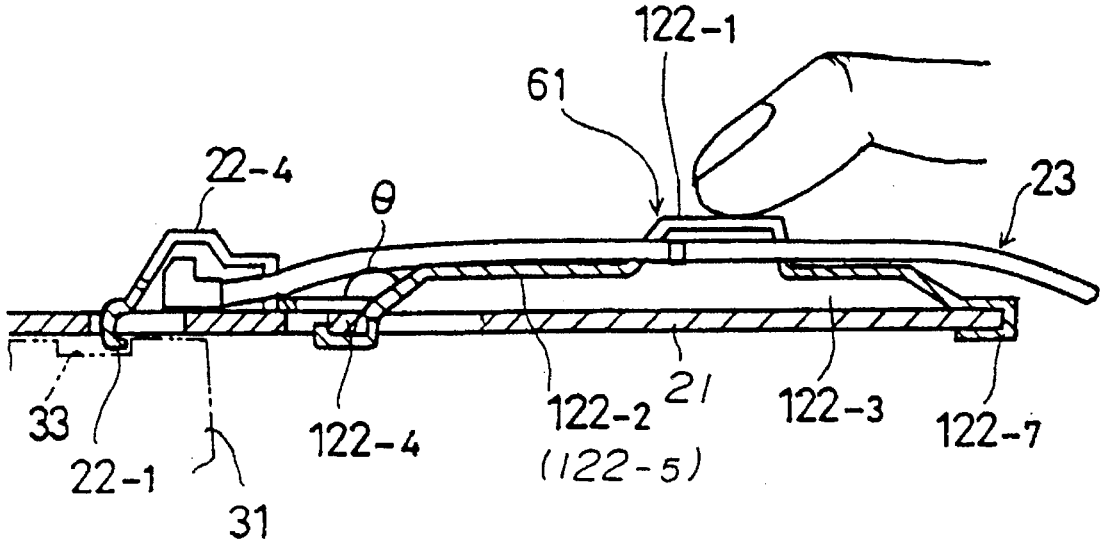
FIGS. 19A and 19B are diagrams illustrating a pull-out operation using a push operating unit according to the second embodiment of the present invention.
Figure 19B:
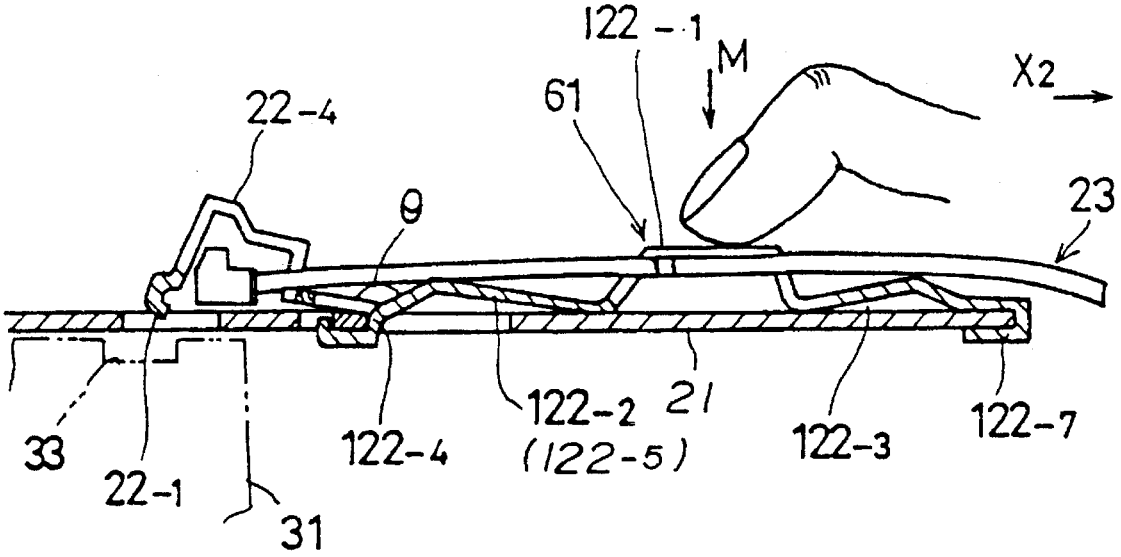

As shown in FIGS. 19A and 19B, the operator pushes the push portions 61 and 61A with a finger, and pulls the connector 60 in the direction indicated by the arrow X2 (FIG. 19B). When the push portion 61 is pushed in a direction indicated by an arrow M (FIG. 19B), the step portions 122-2 and 122-3 are deformed and hence the angle portion 122-1 is made to go down. At this time, the step portion 122-2 becomes so as to be in a state such that the step portion 122-2 can be rotated clockwise about the fulcrum portion 122-4. There is no change of the positional relationship between the step portion 122-2 and the angle portion 22-4 and an angle 8 shown in FIGS. 19A and 19B is not changed. Hence, when the step portion 122-2 is turned clockwise about the fulcrum portion 122-4, the angle portion 22-4 is clockwise turned about the fulcrum portion 122-4. Hence, the claw 22-1 is slipped out of the recess portion 33, so that the latch spring 60 is released from the latched state. A force oriented in the direction indicated by the arrow X2 is exerted on the plug-in connector 60, and pulls the connector 60 out of the jack connector 31. The above operation is easier for the operator than the operation in which the pull tab is pulled.

When the fingers are released from the push portions 61 and 61A, these portions are returned to the original state shown in FIG. 19A due to a spring force stored in the step portions 122-2 and 122-3 in the deformed state.

The present invention is not limited to the specifically disclosed embodiments, and variations and modifications may be made without departing from the scope of the present invention.

What is claimed is:

1. An electrical plug-in connector comprising:

a connector main body having contacts connected to a cable;

a housing accommodating the connector main body;

latch springs respectively attached to first and second surfaces of the housing, the latch springs respectively having first engagement portions of a claw shape which securely engage with second engagement portions of a jack connector in a locked state when said jack connector is connected with the plug-in connector in a mating direction, the latch springs respectively having third engagement portions; and an operating member cooperating with the latch springs, said operating member having a pull tab portion located on a rear side of the connector main body opposite to a front side thereof on which the contacts are provided and said operating member including latch releasing portions respectively contacting the third engagement portions of the latch springs to disengage the first engagement portions of the latch springs from the second engagement portions of the jack connector when the pull tab portion is pulled in a direction opposite to said mating direction to release the plug-in connector from the locked state, the latch releasing portions and the third engagement portions subsequently returning to an undeformed state, due to an elasticity of the latch springs upon release of said pull-tab portion, thereby returning the first engagement portions to an undeformed state.

2. The plug-in connector as claimed in claim 1, wherein said pull tab portion is located along the cable extending from the rear side of the connector main body.

* * * * *

UNITED STATES PATENT AND TRADEMARK OFFICE

CERTIFICATE OF CORRECTION

PATENT NO. : 5,564,939

DATED : October 15, 1996

INVENTOR(S) : Yukihiro MAITANI et al.

It is certified that error appears in the above-indentified patent and that said Letters Patent is hereby corrected as shown below:

Column 1

Line 37, "4b" should be -- 4a --.

Column 4

Line 32, "22" should be -- 22-4 --;

Line 33, "22-4" should be -- 22 --.

Column 5

Line 19, after "The" insert -- fourth engagement portion --.

Column 6

Line 33, "122-2" should be -- 122-3 --.

Column 7

Line 51, "8" should be -- θ --.

Signed and Sealed this

Twenty-second Day of April, 1997

Bruce Lehman

*Attest:*

BRUCE LEHMAN

*Commissioner of Patents and Trademarks*

*Attesting Officer*